United States Patent [19]

Calvert

[11] Patent Number: 4,593,428

[45] Date of Patent: Jun. 10, 1986

[54] ROLLER PAINT GUARD ASSEMBLY

[75] Inventor: Peter W. Calvert, Johnson City, Tenn.

[73] Assignee: Thomas Industries, Inc., Louisville, Ky.

[21] Appl. No.: 730,690

[22] Filed: May 3, 1985

[51] Int. Cl.[4] ..... B05C 17/02; B05C 21/00

[52] U.S. Cl. ..... 15/248 A; 15/230.11; 134/138

[58] Field of Search ..... 15/230.11, 248 A; 134/138, 139, 149; 68/213

[56] References Cited

U.S. PATENT DOCUMENTS

| | | | |
|---|---|---|---|
| 2,488,655 | 11/1949 | Bennett | 15/248 A X |
| 3,441,355 | 4/1969 | Brown | 134/149 X |
| 4,254,529 | 3/1981 | Cooke | 15/248 A X |

*Primary Examiner*—Edward L. Roberts
*Attorney, Agent, or Firm*—Emrich & Dithmar

[57] ABSTRACT

A paint roller guard assembly includes a paint shield adapted to support a paint roller, and a separate handle having a solid threaded mounting end which is received in a threaded connector formed on a side wall of the paint shield to attach the handle to the paint shield during use of the paint guard assembly for painting. The handle is removable from the paint shield to permit a water hose to be connected to the paint shield to supply water under pressure which is discharged through an elongated slot formed through the side wall of the paint shield to impact the paint roller causing it to rotate and simultaneously wash residual paint from the paint roller.

13 Claims, 6 Drawing Figures

FIG. 4
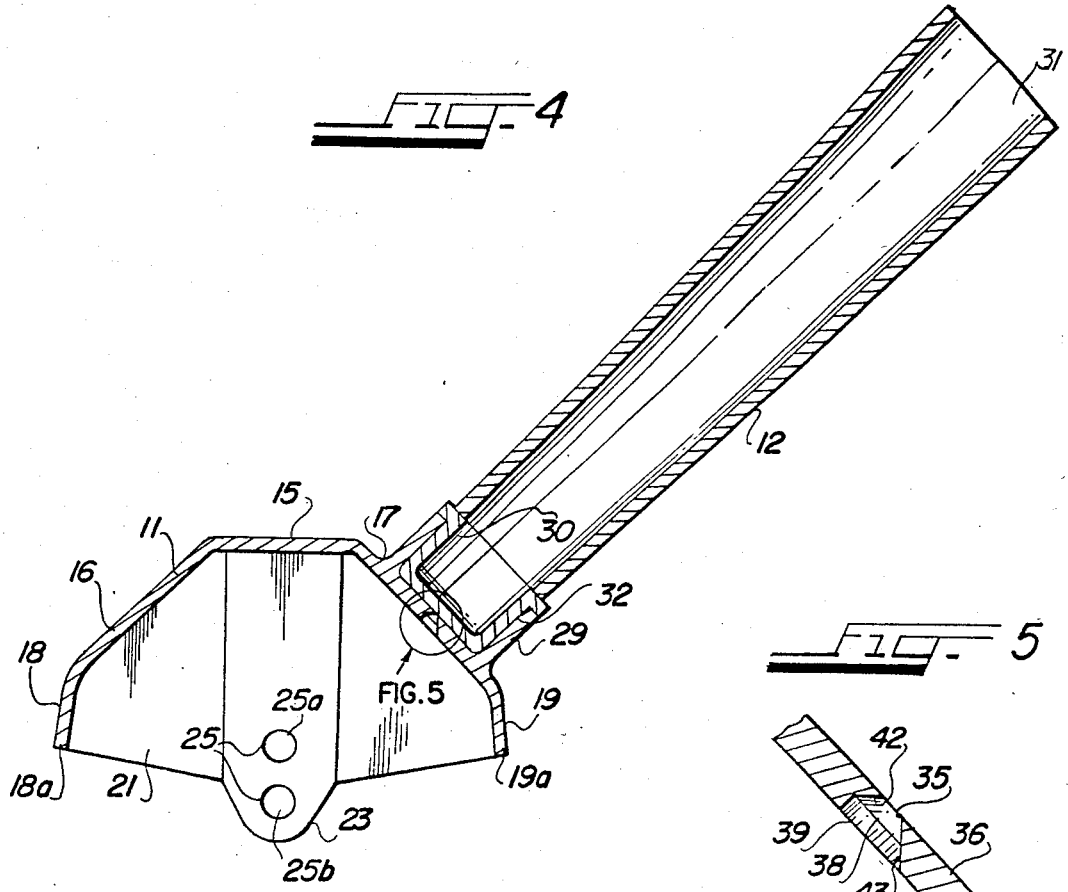
FIG. 5
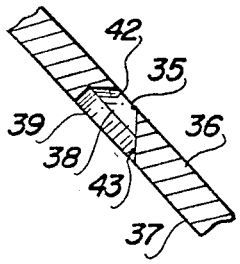
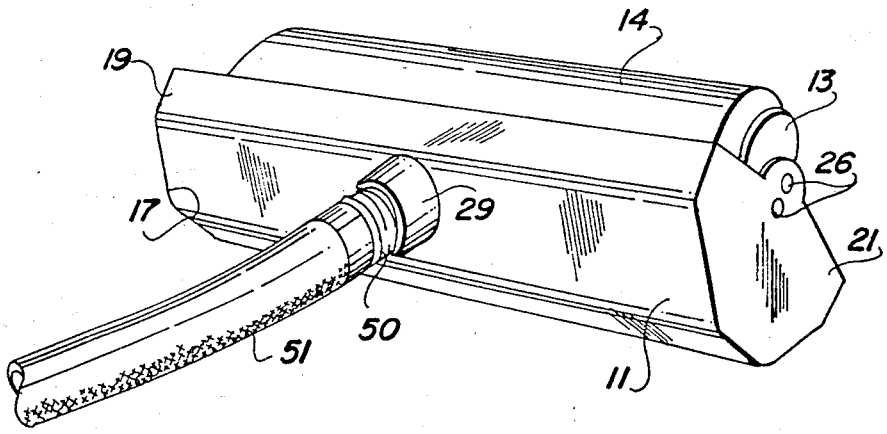
FIG. 6

ROLLER PAINT GUARD ASSEMBLY

BACKGROUND OF THE INVENTION

This invention relates to paint applying roller apparatus of the type having a spray shield and handle, and more particularly to an improved paint applying roller apparatus having a spray shield which facilitates cleaning of the paint roller cover after use.

Various designs for paint applying roller apparatus including spray shields have been proposed in the prior art for the purpose of protecting areas adjacent an area being painted from paint dripping or splattering during painting. One such apparatus disclosed in U.S. Pat. No. 4,254,529 issued on Mar. 10, 1981 to Donald R. Cook and assigned to Padco, Inc., includes a paint spatter shield that is an integral part of the paint roller, the roller cover being attached to the paint shield, and the shield, in turn, being attached to the handle. The shield and the handle are integral components of the paint roller apparatus, being manufactured as one unit. Although such one piece construction obviates the manufacturing step of connecting the handle to the shield as is required in assemblies where the shield and handle are separate elements, the handling and shipping costs are increased because of the bulky package required for the integrally molded unit in which the handle extends normal to the shield. Although the generally rectangular spray shield is designed specifically to allow the user to set the apparatus down anywhere in an inverted position with the shield catching any paint dripping from the paint roller. No special provision is made in the design of the shield for facilitating cleaning of the roller cover.

Another paint roller frame with spray shield is disclosed in U.S. Pat. No. 3,825,970 issued July 30, 1974 to Robert I. Janssen. The paint roller retaining frame comprises a generally semi-cylindrical casing shell having a pair of upstanding ears attached to the outer cylindrical surface securing a handle to the frame. The assembly provides for cleaning of the paint roller only to the extent that edge surface of the spray shield serves to guide and support the nozzle of a water hose to assist in cleaning of the paint roller as the nozzle and water jet are maneuvered axially along the length of the paint roller. The degree of success in cleaning the paint roller as well as the time required depend upon the skill of the user who must direct the jet of water onto the paint roller.

SUMMARY OF THE INVENTION

It is a general object of the invention to provide an improved paint roller guard apparatus.

Another object of the invention is to provide a paint roller guard apparatus including a paint shield of a construction which facilitates cleaning of the paint roller, and which permits such cleaning to be done automatically and unattended.

Another object of the invention is to provide a paint roller guard apparatus of a construction which facilitates handling and shipping of the assembly to customers.

These and other objects of the invention are achieved by the present invention which has provided a paint roller apparatus for releasably receiving a paint roller, suspending the paint roller at least partially contained within an enclosure to shield an area adjacent the area being painted from inadvertent dripping or spraying of paint from the paint roller during use, the apparatus comprising the combination of a paint shield defining the enclosure; a separate handle; and paint roller mounting means including first and second end caps; said paint shield including first and second opposing end walls and a wall portion extending between said end walls and having an elongated slit therethrough intermediate and extending between said end walls, connection means formed integrally with said paint shield on said wall portion, overlying said slit in communication therewith and extending outwardly from said wall portion, said first and second end caps being attached to opposite ends of said paint roller and each having a projecting shaft cooperating with said end walls to mount said paint roller axially of said paint shield for rotational movement about the axis of said paint shield; said handle having a mounting end releasably received by said connection means to attach said handle to said paint shield, said mounting end being located to cover said slit when said handle is in place during use of the apparatus for painting, and said handle being removable from said paint shield to permit a source of water under pressure to be connected to said connection means to discharge water through said slit to impact the paint roller causing it to rotate and simultaneously wash residual paint from the paint roller.

In accordance with a disclosed embodiment, the slit is a generally rectangular opening through said wall portion from first to second planar surfaces thereof and first and second tapered slots or channels extend laterally in a horizontal direction along respective sides of the slit. A lower surface of the slit extends downwardly at an angle relative to the horizontal axis of said slit so that water discharged through the slit is directed laterally towards both ends of the roller and vertically downwardly relative to the axis of the slit to impact the paint roller along substantially its entire lenght, and generally tangential to the roller cover.

In accordance with a feature of the invention, the paint shield comprises a five-sided enclosure having a generally trapezoidal cross-section for said paint shield with each of said ends being generally trapezoidal in shape, providing a paint shield construction of added strength and resistent to warpage and which affords a sturdy support for the removable handle. Each of the end walls includes a pair of position apertures, aligned axially in opposing pairs to receive the projecting shafts of the end caps. The provision of multiple position holes allows use of low and high nap covers as well as specialty covers including foam and texture roller covers.

The connection means comprises a generally annular member formed integrally with said wall portion, projecting outwardly therefrom and having internal threads, for receiving the threaded mounting end of the handle for attaching the handle to the paint shield during use of the apparatus for painting and permitting a standard hose to be attached to the paint shield to facilitate cleaning of the paint roller. The length of the handle is less than the length of the paint roller, permitting the handle to be packed inside the paint roller with end caps in place when the apparatus is not in use.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating and understanding of the invention, there is illustrated in the accompanying drawings a preferred embodiment, from an inspection of which, when considered in connection with the following description, the invention, its construction and operation, and many of its advantages should be readily understood and appreciated.

FIG. 4 is a side view in vertical section of the paint roller guard apparatus shown in FIG. 1;

FIG. 5 is an enlarged view of the portion of the shield included in the circle in FIG. 4, illustrating detail of the configuration of the slit formed therein for allowing water to be introduced rearwardly of the shield for cleaning the roller mounted therein; and FIG. 6 is a perspective view of the roller paint guard apparatus illustrating the shield connected to a water hose to facilitate cleaning of the roller.

DESCRIPTION OF THE PREFERRED EMBODIMENT

Figure 1:
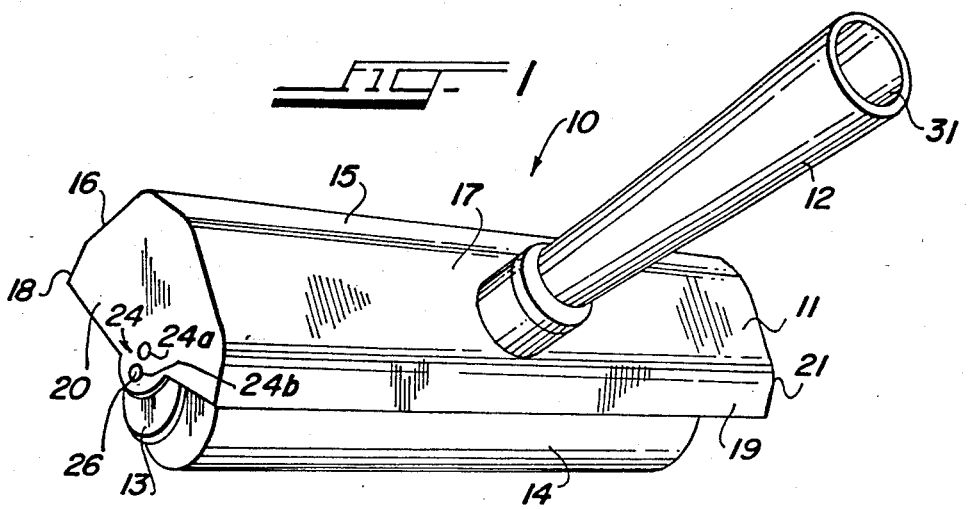
FIG. 1 is a perspective view of a paint roller guard assembly provided by the present invention.

Referring to FIG. 1, there is illustrated a paint roller guard assembly 10 provided by the present invention. The assembly 10 includes a paint shield 11, a separate handle 12, and a pair of molded end caps, such as end cap 13 which are adapted to be received in the ends of a paint roller and cover 14 to facilitate supporting the paint roller 14 within the shield 11.

Referring to FIGS. 1 and 4, the shield 11 is a five sided member having a generally trapezoidal lateral cross-section. The integrally formed, one piece shield 11 includes a top 15, a first pair of sides 16 and 17 and a second pair of sides 18 and 19, and ends 20 and 21. The top 15 and the sides 16–19 are generally rectangular in shape. The sides 16 and 17 extend diagonally between the top 15 and respective sides 18 and 19 at an angle of approximately 45 degrees relative to the plane the top 15. The lower sides 18 and 19 terminate at essentially parallel lower edges 18*a* and 19*a*, respectively. The ends of the shield 11 are enclosed by the end members 20 and 21, each of which is a flat plate-like member which is generally trapezoidal in shape. The five-sided configuration affords added rigidity and resists warpage.

Figure 3:
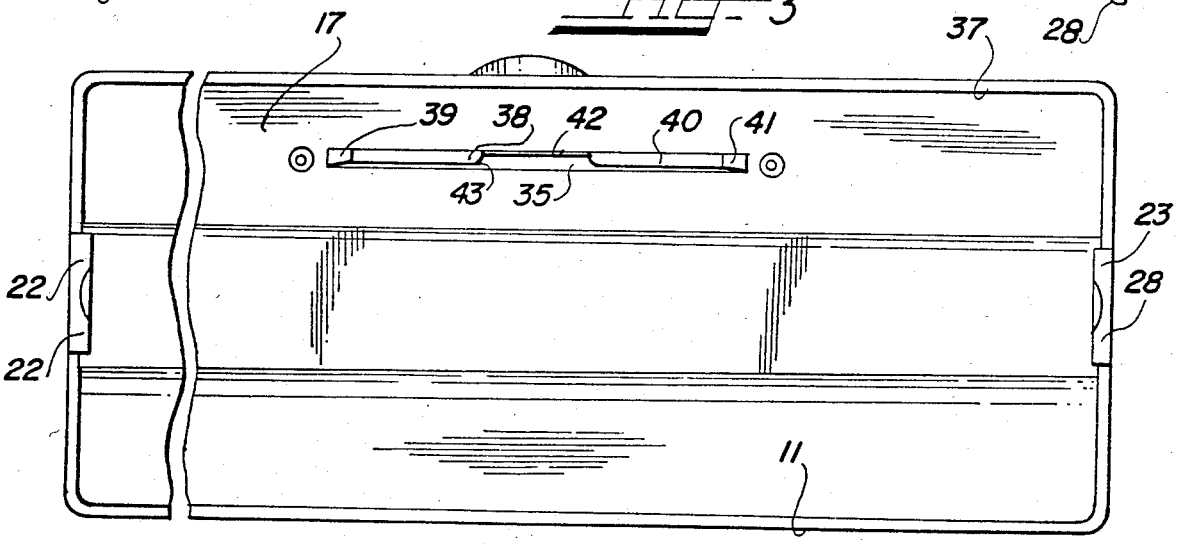
FIG. 3 is a bottom plan view of the shield shown in FIG. 2.

Each of the ends 20 and 21 includes a semi-circular projection 22 and 23, respectively, each provided with a pair of position holes 24 and 25, respectively which receive projecting shafts 26 of the end caps 13 for rotatably mounting the present roller 14 in the paint shield 11. Holes 24*a* and 24*b* are of hole pair 24 aligned with respective holes 25*a* and 25*b* of hole pair 25 axially of the paint shield 11. The provision of two hole pairs 24 and 25 allows for placement of the roller cover at two heights within the shield. This allows the shield to be used with low and high nap covers, up to one inch nap lengths, as well as specialty covers including foam and texture roller covers. The two position holes 24 and 25 are punched out of the center portion of each end 20 and 21 which is molded of a double thickness as illustrated in FIGS. 3 and 4 for added strength and durability.

The molded end caps 13 fit snuggly into any standard nine inch roller cover and each includes a projecting shaft 26 which is received in the appropriate position hole of a pair of the axially aligned position holes, depending on the type of roller being used. Referring to FIG. 3, the top edges 27 and 28 above each pair of position holes are tapered so the roller cover with end caps 13 in place can easily be slipped into the position holes.

Figure 2:
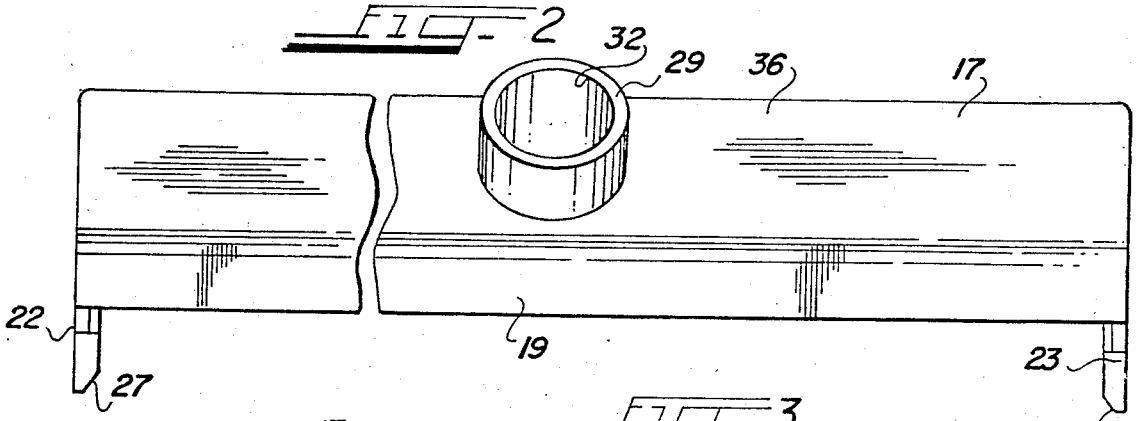
FIG. 2 is a rear elevation view of the paint shielf of the paint roller guard apparatus of FIG. 1.

Referring to FIGS. 2 and 4, side 17 of the shield 11 has molded thereto a threaded connector 29 for screwing and mounting the handle 12. The connector 29 is a ring shaped member formed with an internal thread portion 32, which is preferably standard garden hose thread size. The connector 29 is located in the center of the side 17 with its longitudinal axis extending substantially perpendicular to side 17.

The handle 12 is separately molded and has a solid mounting end 30 formed with a standard male garden hose thread which is received by the threaded female connector 29 on the shield 11. The opposite end 31 of the hnndle 12 is hollow and tapered to receive an extension pole (not shown). This hollow end 31 is not threaded but is of suffient taper to allow a standard style extension pole to wedge into place.

The length of the handle 12 is less than the length of the paint roller 14 so that the handle 12, when detached, may be packed inside the roller cover with the end caps 13 in place and then mounted within the shield 11. This forms a compact package for shipping to customers as well as for storage by a user.

The paint roller guard assembly 10 is particularly suitable for use with water base paints which allow cleaning of the roller cover using water. For the purpose of facilitating cleaning of the paint roller after use, the side 21 to which the handle 12 is attached includes a rectangular slit 35, shown best in FIG. 3, formed therethrough communicating the interior of the shield 11 with the interior of the hollow female connector 29. As shown in FIGS. 3 and 5, the portions of the side 17 on either side of the slit 35 are tapered from the outer surface 36 to the inner surface 37, defining first tapered slot portions 38 and 39 and second tapered slot portions 40 and 41. In addition, with reference to FIG. 5, the lower surface 43 of the slit extends downwardly at an angle of approximately 45 to 50 degrees relative to the center line of the slit 35 from the outer surface 36 to the inner surface 37 of the side 17. The upper surface 42 includes a portion which extends upwardly at an angle of approximately 45–50 degrees relative to the center line of the slit 35 to a point midway through the side 17 and then extends generally parallel to the axis of the slit 35.

The configuration of the slit 35 causes water introduced through the connector 29 to the slit 35 to be discharged into the shield and directed downwardly, generally tangential to the surface of the roller cover and laterally towards both ends of the roller cover to impact the roller cover 14 with a fan-shaped jet of water which causes the roller to spin at high speed and simultaneously washes residual paint from the roller cover. The connector 29 is of sufficient depth to permit a standard hose washer to be inserted into the connector and engaged by the tip of the handle 12. Thus, the solid threaded tip of the handle 12 not only facilitates attaching the handle 12 to the shield, but also covers the slit 35, preventing paint from leaking through the rectangular slit 35 while the apparatus is being used for painting.

Referring to FIG. 6, for cleaning the roller cover after use, the handle 12 is removed, and the male end 50 of a conventional domestic garden hose 51 may be threaded into the connector 29 to communicate the passage with a suitable source of water under pressure, the water being discharged into the shield through the slit 35. The configuration of the slit 35 forms and directs a strong jet of water onto the roller cover causing it to spin at relatively high speeds, simultaneously washing out residual paint and thus cleaning the paint roller. Since the hose is connected to the shield and because the configuration of the slit 35 forms and directs the water spray as required to clean the paint roller, once the hose is attached, the cleaning operation can be done unattended and automatically.

I claim:

1. In a paint roller apparatus for releasably receiving a paint roller, suspending the paint roller at least partially contained within an enclosure to shield an area adjacent the area being painted from inadvertent dripping or spraying of paint from the paint roller during use, the combination comprising:

a paint shield defining the enclosure;

a separate handle; and paint roller mounting means including first and second end caps;

said paint shield including first and second opposing end walls and a wall portion extending between said end walls and having an elongated slit therethrough intermediate and extending between said end walls, connection means formed integrally with said paint shield on said wall portion, overlying said slit in communication therewith and extending outwardly from said wall portion, said first and second end caps being attached to opposite ends of said paint roller and each having a projecting shaft cooperating with said end walls to mount said paint roller axially of said paint shield for rotational movement about the axis of said paint shield;

said handle having a mounting end releasably received by said connection means to attach said handle to said paint shield, said mounting end being located to cover said slit when said handle is in place during use of the apparatus for painting, and said handle bring removable from said paint shield to permit a source of water under pressure to be connected to said connection means to discharge water into the shield through said slit to impact the paint roller causing it to rotate and simultaneously wash residual paint from the paint roller.

2. Apparatus according to claim 1, wherein said slit includes a generally rectangular opening through said wall portion from first to second planar surfaces thereof and first and second tapered slot portions extending horizontally on respective sides of said opening to direct water discharged through said slit laterally towards both ends of the paint roller to impact the paint roller substantially along the entire length thereof.

3. Apparatus according to claim 2, wherein said slit includes upper and lower surfaces, at least said lower surface extending downwardly at an angle relative to the axis of said slit to direct a portion of the water discharged through said slit vertically downwardly relative to the axis of the slit to impact the paint roller tangentially along substantially the entire length thereof.

4. Apparatus according to claim 1, wherein said mounting end of said handle has external threads and wherein said connection means comprises a generally annular member formed integrally with said wall portion, projecting outwardly therefrom and having internal threads, for receiving said threaded mounting end of said handle for attaching said handle to said paint shield during use of the apparatus for painting and permitting a standard hose to be attached to said paint shield to facilitate cleaning of the paint roller.

5. Apparatus according to claim 1, wherein the length of said handle is less than the length of the paint roller, permitting said handle to be stored with said paint roller when the apparatus is not in use.

6. Apparatus according to claim 1, wherein said paint shield comprises a top, first and second sides, third and fourth sides and said first and second end walls;

said first and second sides extending in a generally parallel relation, spaced apart a distance greater than the width of said top;

said third and fourth sides, respectively, extending at an angle relative to the plane of said top, between edges of said first and second sides and edges of said top, and being formed integrally therewith to define a generally trapezoidal cross-section for said paint shield, and each of said end walls being generally trapezoidal in shape and said slit being formed in said third side.

7. Apparatus according to claim 6, wherein said third and fourth sides extend at an angle of approximately 45 degrees relative to the plane of said top.

8. Apparatus according to claim 6, wherein each of said end walls includes a pair of apertures, the apertures of said end walls being aligned longitudinally in opposing pairs to receive projecting shafts of said first and second end caps in a given aligned pair of an opposing pair of apertures.

9. Apparatus according to claim 8, wherein each of said end walls includes reinforced surface portions, and said apertures being formed in said reinforced surface portions.

10. In a paint roller apparatus for releasably receiving a paint roller, suspending the paint roller at least partially contained within an enclosure to shield an area adjacent the area being painted from inadvertent dripping or spraying of paint from the paint roller during use, the combination comprising:

a paint shield defining the enclosure;

a separate handle; and paint roller mounting means including first and second end caps;

said paint shield including a planar top, first and second sides, third and fourth sides and first and second end walls, said first and second sides extending in a generally parallel relation, spaced apart a distance greater than the width of said top, said third and fourth sides, respectively, extending at an angle relative to the plane of said top between edges of said first and second sides and edges of said top and being formed integrally therewith to define a generally trapezoidal cross-section for said paint shield, and each of said end walls being generally trapezoidal in shape; said third side having an elongated slit therethrough intermediate said end walls, and connection means formed integrally with said third side overlying said slit in communication therewith and extending outwardly therefrom, said first and second end caps being attached to opposite ends of said paint roller and each having a projecting shaft cooperating with said end walls to mount said paint roller for rotational movement within said paint shield;

said handle having a mounting end releasably received by said connection means to attach said handle to said paint shield, said mounting end being located to cover said slit when said handle is in place during use of the apparatus for painting, and said handle being removable from said paint shield to permit a soure of water under pressure to be connected to said connection means to discharge water into the shield through said slit to impact the paint roller, causing it to rotate and simultaneously wash residual paint from the paint roller.

11. Apparatus according to claim 10, wherein said slit includes a generally rectangular opening through said third wall from first to second planar surfaces thereof, and first and second tapered slot portions extending horizontally on respective sides of said opening to direct water discharged through said slit laterally towards both ends of the paint roller to impact the paint roller along substantialy its entire length.

12. Apparatus according to claim 11, wherein said slit includes upper and lower surfaces, at least said lower surface extending downwardly at an angle relative to the axis of said slit to direct a portion of the water discharged through said slit downwardly relative to the axis of the slit to impact the paint roller tangentially along substantially its entire length.

13. Apparatus according to claim 10, wherein said mounting end of said handle has external threads, and wherein said connection means comprises a generally annular member formed integrally with said third side and projecting outwardly therefrom and having internal threads for receiving said threaded mounting end of said handle for attaching said handle to said paint shield during use of the apparatus for painting and permitting a standard hose to be attached to said paint shield to facilitate cleaning of the paint roller.

* * * * *

UNITED STATES PATENT AND TRADEMARK OFFICE

CERTIFICATE OF CORRECTION

PATENT NO. : 4,593,428

DATED : June 10, 1986

INVENTOR(S) : Peter W. Calvert

It is certified that error appears in the above-identified patent and that said Letters Patent is hereby corrected as shown below:

Column 2, line 38, [lenght], should be -- length --

Column 3, line 14, [shielf], should be -- shield --

Column 3, line 47, reads, [to the plane the top[, should read -- to the plane of the top --

Column 4, line 24, [hnndle], should be -- handle --

Column 4, line 26 [suffient], should be -- sufficient--

Signed and Sealed this

*Second* Day of *September 1986*

[SEAL]

*Attest:*

DONALD J. QUIGG

*Attesting Officer*

*Commissioner of Patents and Trademarks*